US006311677B1

(12) United States Patent
Cook et al.

(10) Patent No.: US 6,311,677 B1
(45) **Date of Patent: *Nov. 6, 2001**

(54) ENGINE MOUNTING OF AN EXHAUST GAS RECIRCULATION VALVE

(75) Inventors: John Edward Cook, Chatham (CA); Scott Hussey, Clinton Township, MI (US)

(73) Assignee: Siemens Canada Limited, Mississauga (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/538,807

(22) Filed: Mar. 30, 2000

(51) Int. Cl.[7] ..... F02M 25/07
(52) U.S. Cl. ..... 123/568.12; 123/568.17
(58) Field of Search ..... 123/568.12, 568.13, 123/568.17, 568.18, 568.11, 41.17, 41.31, 41.72

(56) References Cited

U.S. PATENT DOCUMENTS 5,666,930 * 9/1997 Elder ..... 123/568.12
6,152,115 * 11/2000 Busato et al. ..... 123/568.17
6,186,127 * 2/2001 Everingham ..... 123/568.12

* cited by examiner

*Primary Examiner*—Andrew M. Dolinar
*Assistant Examiner*—Arnold Castro

(57) ABSTRACT

An internal combustion engine cylinder head (142) has an exterior wall that contains a walled compartment (140). A wall of that compartment is exposed to an internal coolant passage (146) through which liquid coolant circulates. An exhaust gas passageway (160) running through the compartment has an exhaust gas entrance (162) into the compartment and an exhaust gas exit (164) from the compartment. The compartment comprises a receptacle (148) that intersects the exhaust gas passageway between the entrance and the exit. An EGR valve (10) disposed on the exterior wall comprises a base (12) that has an inlet port (30) and an outlet port (32) and that is disposed within the receptacle with the inlet port open to the entrance via the passageway and the outlet port open to the exit via the passageway. As hot exhaust gas is recirculated, coolant that circulates through the coolant passage aids in limiting peak temperatures to which the valve may be subjected.

20 Claims, 1 Drawing Sheet

ENGINE MOUNTING OF AN EXHAUST GAS RECIRCULATION VALVE

FIELD OF THE INVENTION

This invention relates generally to automotive emission control valves. More specifically it relates to an engine mounting of an exhaust gas recirculation (EGR) valve.

BACKGROUND OF THE INVENTION

Controlled engine exhaust gas recirculation is a commonly used technique for reducing oxides of nitrogen in products of combustion that are exhausted from an internal combustion engine to atmosphere. A known EGR system comprises an EGR valve that is controlled by an electric circuit in accordance with various engine operating conditions to regulate the amount of engine exhaust gas that is recirculated to the induction fuel-air flow entering the engine for combustion so as to limit the combustion temperature and hence reduce the formation of oxides of nitrogen.

When an EGR valve is engine-mounted, it is exposed to a harsh operating environment that includes wide temperature extremes and vibrations. Exhaust emission requirements impose more stringent demands for improved control of such valves, and a valve that contains both an electric actuator for positioning the valve member and a position sensor for providing feedback of the valve member position to the control circuit may be capable of providing improved control. In order for such a valve to be commercially successful, its components must be able to perform properly in such extreme environments for an extended period of usage. Moreover, in mass-production automotive vehicle applications, component cost-effectiveness and size may be significant considerations. An EGR valve that possesses more accurate and quicker response can be advantageous by, providing improved control of tailpipe emissions, improved driveability, and/or improved fuel economy for a vehicle having an internal combustion engine that is equipped with an EGR system.

Size of an EGR valve may also be an important consideration in its commercial appeal. A valve that is more compact in size can be advantageous because of limitations on available space in a vehicle engine compartment and/or on a engine.

SUMMARY OF THE INVENTION

The present invention relates generally to an improvement in mounting an EGR valve, especially an electric EGR valve of the type described herein, directly on an engine, an engine cylinder head in particular. Such a mounting can serve to reduce the number of parts required in an EGR valve, because certain structure in the engine itself cooperates with associated structure of the EGR valve in a manner that more efficiently integrates the valve/engine combination. The integration achieved by the invention also enables certain connections and attachments either to be simplified, or to be eliminated entirely. Certain functional benefits also arise from the inventive mounting.

Because the mounting provides improved proximity to the engine cylinders, the distance that exhaust gas must traverse from EGR valve to engine cylinders may be shortened, and hence exhaust gas transport time from the EGR valve to the cylinders reduced. This promotes faster response to changing EGR requirements as the engine runs.

The mounting also disposes the EGR valve in association with a coolant passage in the cylinder head. The flow of liquid coolant through that passage provides beneficial cooling of the EGR valve that avoids high temperature extremes. Limiting temperature rise is especially desirable for an electric-operated EGR valve where high temperatures that are characteristic of the exhaust gases flowing through the valve may influence operating characteristics of the electric actuator in ways that might otherwise upset intended control strategy. Indeed, it is considered desirable for the mounting to provide thermal conductivity between the valve housing and the coolant passage that is conducive to effective heat transfer away from the actuator. Hence intimate metal-to-metal contact between the valve body and the cylinder head is to be encouraged.

A general aspect of the present invention relates to an internal combustion engine comprising a cylinder head comprising an exterior wall that contains a walled compartment. That compartment comprises a wall exposed to an internal coolant passage in the head through which passage liquid coolant circulates. An exhaust gas passageway running through the compartment has an exhaust gas entrance into the compartment and an exhaust gas exit from the compartment. The compartment comprises a receptacle that intersects the exhaust gas passageway between the entrance and the exit. An EGR valve disposed on the exterior wall comprises a base that has an inlet port and an outlet port and that is disposed within the receptacle with the inlet port open to the entrance via the passageway and the outlet port open to the exit via the passageway.

Another general aspect of the invention relates to an internal combustion engine comprising a part having an exterior wall, a portion of which is covered on the exterior by an EGR valve. The valve comprises a stamped metal base containing an inlet port and an outlet port, and the portion of the exterior wall covered by the EGR valve comprises a walled compartment having a wall exposed to an internal coolant passage which passes internally through the part and through which liquid coolant circulates. An exhaust gas passageway running through the walled compartment comprises an exhaust gas entrance into the compartment and an exhaust gas exit from the compartment. The compartment comprises a receptacle that intersects the exhaust gas passageway between the entrance and the exit. The EGR valve inlet port and outlet port are disposed within the receptacle with the inlet port open to the entrance via the passageway and the outlet port open to the exit via the passageway.

The foregoing, and other features, along with various advantages and benefits of the invention, will be seen in the ensuing description and claims which are accompanied by drawings. The drawings, which are incorporated herein and constitute part of this specification, disclose a preferred embodiment of the invention according to the best mode contemplated at this time for carrying out the invention.

DESCRIPTION OF THE PREFERRED EMBODIMENT

Figure 1:
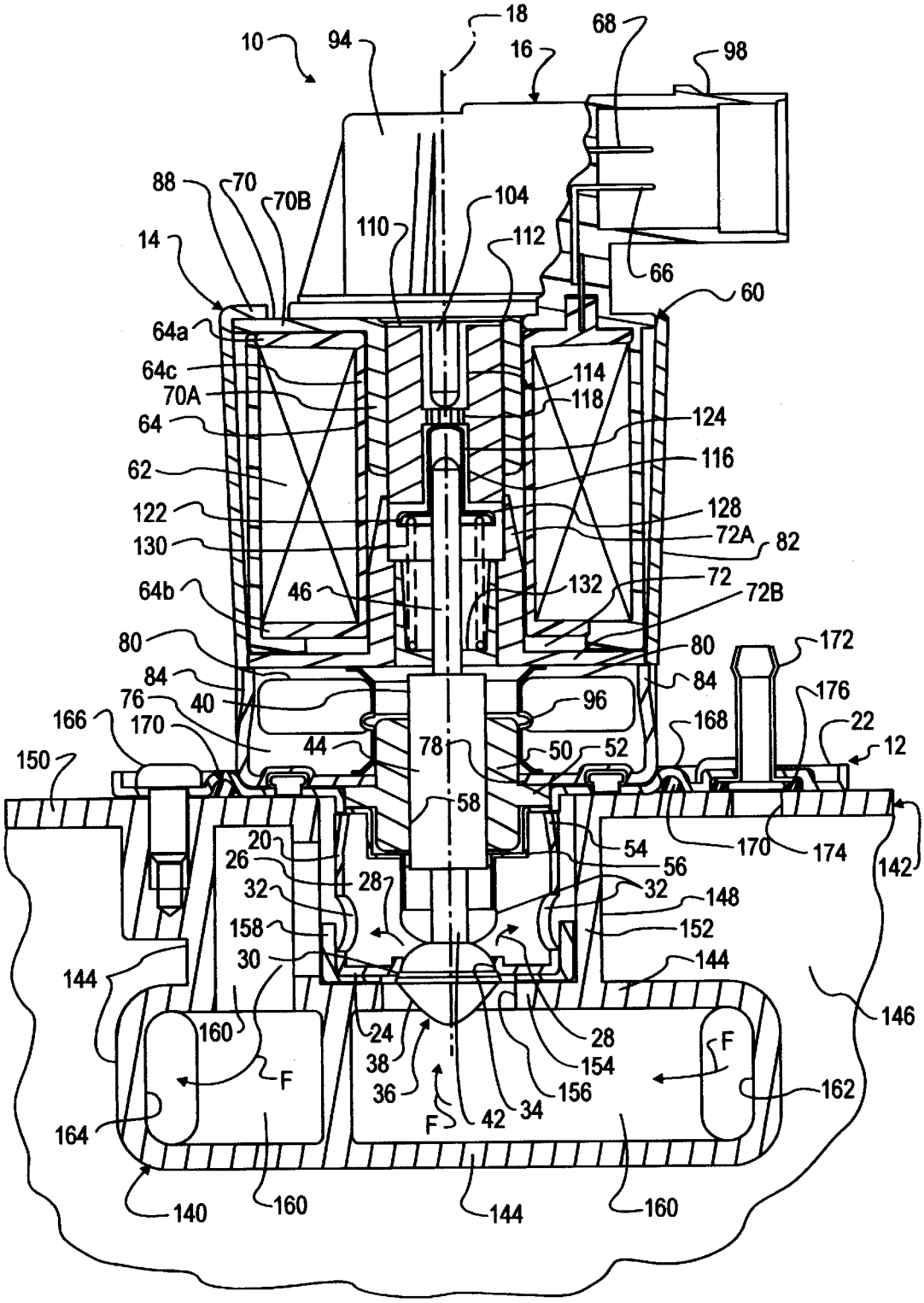
FIG. 1 is a vertical cross section view of an electric EGR valve (EEGR valve) and its mounting on an engine in accordance with principles of the invention.

FIG. 1 illustrates an engine-mounted electric EGR valve (EEGR valve) 10 embodying principles of the present invention. Because certain features of EEGR valve 10 are important to its mounting on an engine, valve 10 will first be described in detail. The valve comprises valve body structure composed of a stamped metal base 12, a generally cylindrical metal shell 14 disposed on top of base 12, and a non-metallic cap 16 atop shell 14. FIG. 1 also shows the internal construction of valve 10 which may, for convenience, be described with reference to an imaginary longitudinal axis 18 that is generally vertical when the valve is mounted on an engine as shown.

Base 12 comprises a central cylindrical cup 20 coaxial with axis 18 and a generally circular radial flange 22 that adjoins the rim of cup 20. Cup 20 itself comprises a bottom wall 24 and a side wall 26 that extends between bottom wall 24 and flange 22. Cup 20 defines a main internal exhaust gas passage 28 through EEGR valve 10. That passage has an entrance, or inlet port, 30 in bottom wall 24 concentric with axis 18 and an.exit, or outlet port, 32 that is formed as several through-holes circumferentially spaced apart in side wall 26 slightly above bottom wall 24.

Inlet port 30 includes a formation creating a valve seat 34 concentric with axis 18 at inlet port 30. A one-piece, non-flow-through valve member 36 is coaxial with axis 18 and comprises a non-flow-through valve head 38 and a valve stem, or valve shaft, 40 extending co-axially from head 38. Head 38 is shaped for cooperation with valve seat 34 by having an outer perimeter that is shaped to include a tapered surface of revolution that has full circumferential contact with seat 34 when the valve is in closed position shown in FIG. 1. Stem 40 comprises a first circular cylindrical segment 42 extending from head 38, a second circular cylindrical segment 44 extending from segment 42, and a third circular cylindrical segment 46 extending from segment 44. It can be seen that segment 44 has a larger diameter than either segment 42, 46. Valve member 36 is shown as a one-piece structure formed from a homogeneous material. Thus the illustrated valve member 36 is a monolithic structure. Alternatively, valve member 36 can be fabricated from two or more individual parts assembled integrally to form a one-piece valve member structure.

Valve 10 further comprises a bearing member 50 which basically has a circular cylindrical shape except for a circular flange 52 intermediate its opposite axial ends. Base 12 comprises several tabs 54 lanced inward out of cup side wall 26 just below flange 22 to define circumferentially spaced apart surfaces forming a ledge, or shoulder, around the inside of the cup side wall concentric with axis 18. A deflector member 56 fits over one axial end of bearing member 50, and it and the end of the deflector member onto which it fits are received in the open upper end of cup 20 with a perimeter flange of deflector member 56 resting on the ledge formed by tabs 54.

Deflector member 56 is a metal part shaped to fit with conformance to the portion of bearing member 50 below flange 52 that is disposed within cup 20 while providing clearance to the portion of stem 40 that protrudes from bearing member 50 into the interior of the cup. Deflector member 56 terminates a distance from valve head 38 so as not to restrict exhaust gas flow through passage 28 when the valve is open, but at least to some extent deflect the gas away from stem 40 and bearing member 50.

Bearing member 50 further comprises a central circular through-hole, or through-bore, 58 with which stem segment 44 has a close sliding fit. Bearing member 50 comprises a material that possesses some degree of lubricity providing for low-friction guidance of valve member 36 along axis 18.

Shell 14 contains an electromagnetic actuator, namely a solenoid, 60 coaxial with axis 18. Actuator 60 comprises an electromagnetic coil 62 and a polymeric bobbin 64. Bobbin 64 comprises a central tubular core 64*c* and flanges 64*a*, 64*b* at opposite ends of core 64*c*. Coil 62 comprises a length of magnet wire wound around core 64*c* between flanges 64*a*, 64*b*. Respective terminations of the magnet wire are joined to respective electric terminals 66, 68. The exterior of the winding may be covered by an encapsulation layer that extends between the bobbin flanges as illustrated.

Actuator 60 comprises stator structure associated with coil 62 to form a portion of a magnetic circuit path. The stator structure comprises an upper pole piece 70, disposed at one end of the actuator coaxial with axis 18, and a lower pole piece 72 disposed at the opposite end of the actuator coaxial with axis 18. A portion of the wall of shell 14 that extends between pole pieces 70, 72 completes the stator structure exterior of the coil and bobbin.

An annular air circulation space 76 is provided within shell 14 axially intermediate actuator 60 and an end wall 78 of shell 14 that is disposed against a central region of base 12. This air space is open to the exterior by several air circulation apertures, or through-openings, 80 extending through a side wall 82 of shell 14 above end wall 78.

Side wall 82 has a slight taper that narrows in the direction toward base 12. In the portion of the shell side wall that bounds space 76, several circumferentially spaced tabs 84 are lanced inward from the side wall material to provide surfaces forming a ledge, or shoulder, on which an outer perimeter of lower pole piece 72 rests. Proximate its open upper end, the shell side wall contains a flange 88 that is directed radially inward to overlie upper pole piece 70, thereby axially capturing it, solenoid 60, and lower pole piece 72 within the shell interior.

Cap 16 mounts atop solenoid 60 and upper pole piece 70 in any suitable manner. At the location of electric terminals 66, 68, upper pole piece 70 has a shape that provides clearance to the terminals and the material of cap 16 that encloses them, so that they can pass through to an electric connector 98 formed by cap material surrounding exposed external terminations of the two terminals. Connector 98 is adapted for mating connection with a wiring harness connector (not shown) for connecting the actuator to an electric control circuit. Cap 16 also comprises a tower 94 providing an internal space for a position sensor (not shown in the drawing) that is arranged to follow the position of valve member 36.

The construction of valve 10 is such that leakage. between passage 18 and air circulation space 76 is prevented. Bearing member through-hole 58 is open to passage 18, but valve stem section 44 has a sufficiently close sliding fit therein to substantially occlude the through-hole and prevent leakage between passage 18 and air circulation space 76 while providing low-friction guidance of the stem. and enabling the pressure at outlet port 32 to act on the cross-sectional area of stem section 44. Within space 76, a deflector 96 circumferentially bounds the portion of the stem that passes through the space., Deflector 96 is shown to comprise a circular cylindrical thin-walled member whose opposite axial ends are flared to engage lower pole piece 72 and shell end wall 78 respectively thus forming a barrier that prevents air in the air circulation space from reaching the stem. The lower end portion of deflector 96 is shown to fit closely around the upper end portion of bearing member 50 which stops short of lower pole piece 72. In the absence of deflector 96, the stem would be directly exposed to foreign material, muddy water for example, that might enter space 76.

Upper pole piece 70 comprises a central cylindrical-walled axial hub 70A and a radial flange 70B at one end of hub 70A. Flange 70B provides the clearance mentioned above that allows for passage of terminals 66, 68 from bobbin 64 to connector 98. Hub 70A is disposed co-axially within the upper end of the through-hole in bobbin core 64*c*, with bobbin flange 64*a* disposed against flange 70B. This axially and radially relates the bobbin and the upper pole piece. Lower pole piece 72 comprises a central hub part 72 and a rim part 72B.

Actuator 60 further comprises an armature 110 that in cooperation with the stator structure completes the actuator's magnetic circuit path. Armature 110 comprises a unitary ferromagnetic cylinder that is guided within a surrounding thin-walled, non-magnetic, cylindrical sleeve 112 that is mounted to extend between the hubs of pole pieces 70 and 72 within the bobbin core through-hole. Armature 110 has opposite axial end surfaces that are perpendicular to axis 18. A respective walled circular hole 114, 116 extends from a respective end surface into the armature coaxial with axis 18. Within the armature, the inner ends of these holes 114, 116 are separated by a transverse wall 118 of the armature. A series of circular holes that are centered about the armature axis extend through wall 118 between the two holes 114, 116. Through-holes 120 that extend through wall 118 between holes 114 and 116 provide for the equalization of air pressure at opposite axial ends of armature 110.

Stem segment 46 comprises a free distal end portion on which a locator member 122 is disposed and secured. Locator member 122 comprises a cylindrical side wall 124 having a hemispherical dome at one axial end and a rimed flange 128 at the other. The dome of locator member 122 is disposed within hole 116 to bear against wall 118. Rimmed flange 128 is external to hole 116 to provide a seat for one axial end of a helical coil spring 130 that is disposed about stem section 46. The opposite end of spring 130 seats on a surface of an end wall 132 of hub 72A.

FIG. 1 shows the closed position of valve 10 wherein spring 130 is pre-loaded, forcing valve head 38 closed against valve seat 34. Accordingly, flow through passage 18 between ports 30 and 32 is blocked. The effect of spring 130 also biases the dome of locator member 122 into direct surface-to-surface contact with transverse wall 118 of armature 110. This, a single load operative connection is formed between armature 110 and locator member 122. The nature of such a connection provides for relative pivotal motion between the two such that force transmitted from one to the other is essentially exclusively axial. A spring bias provided by the position sensor housed within cap 16 causes a shaft 104 of the position sensor to be biased into direct surface-to-surface contact with the surface of wall 118 opposite the surface with which the locator member dome is in contact.

As electric current begins to increasingly flow through coil 62, the magnetic circuit exerts increasing force urging armature 110 in the downward direction. Once the force is large enough to overcome the bias of the pre-load force of spring 130, armature 110 begins to move downward, similarly moving valve member 36 because of the action of wall 118 on locator member 122. This unseats valve head 38 from seat 34, opening the valve to allow flow through passage 18 between ports 30 and 32. The position sensor shaft 104 is maintained in contact with wall 118 to follow the motion. The extent to which the valve is allowed to open is controlled by the electric current in coil 62, and by tracking the extent of valve motion, the position sensor provides a feedback signal representing valve position, and hence the extent of valve opening. The signal is supplied via other terminals of connector 98 which do not appear id FIG. 1. The actual control strategy for the valve is determined as part of the overall engine control strategy embodied by the electronic engine control.

Certain additional features that may be present in valve 10 are not described here, but they are disclosed in one or more commonly owned patents, such as U.S. Pat. Nos. 5,901,940 and 5,901,690 for example.

The EEGR valves that are described in those two commonly owned patents include bases that are not stamped metal parts, but rather cast or sintered metal parts of substantial bulk and thermal mass. They inherently contribute to a significant amount of the valve weight. The valve seat is a separate element that is inserted into a passage in the cast or sintered metal base.

An advantage of EEGR valve 10 described herein is that base 12 is a stamped metal part, one that is believed significantly lighter and less costly to fabricate than a base of cast or sintered metal. The valve seat may also be formed integrally in the stamped base, but more general principles of the invention contemplate the possibility of a separate seat element assembled to a stamped base. To provide for dissipation of heat from EEGR valve 10 in the absence of a machined base, the valve has a novel association with certain structural elements, or features, of an internal combustion engine on which the valve mounts. Those elements of the engine are shown in FIG. 1.

The engine comprises a metal cylinder head fabricated by known fabrication methods, such as casting, followed by machining. When the cylinder head is cast, certain features that intended for cooperation with EEGR valve 10 can be inherently incorporated. Those features, in accordance with principles of the present invention, are shown in FIG. 1 to include a walled compartment 140 that is an integral formation in a cast cylinder head 142.

Compartment 140 has walls, 144 generally, that are exposed to a coolant passage 146 that runs through head 142. As liquid coolant circulates through the engine cooling system, some coolant flows through passage 146 to provide cooling for compartment 140. Compartment 140 is structured to provide a mounting for EEGR valve 10. That structure includes a depression forming a receptacle 148 that extends into passage 146 from an exterior wall 150 of head 142. Receptacle 148 receives cup 20 of valve 10 when base 12 is disposed against the external surface of a portion of wall 150 surrounding receptacle 148.

Receptacle 148 comprises a cylindrical side wall 152 and a bottom end wall 154 which contains a through-hole 156 that is coaxial with axis 18 and has clearance to valve head 38, as shown. An annular seal 158, that may have some flexibility, is disposed between the bottom of cup 20 and the bottom of receptacle 148, as shown, to prevent gas leakage from through-hole 156 into space within receptacle 148 that surrounds side wall 26 of cup 20. The particular seal 158 has an end wall that is disposed against receptacle end wall 154 and an adjoining side wall that is disposed against a portion of receptacle side wall 152 that adjoins end wall 154.

Compartment 140 provides a passageway 160 for exhaust gas flow marked by the arrows F. That passageway has an entrance 162 that is open to engine exhaust gas and an exit 164 that is open to engine intake flow. Because head 142 is proximate both an exhaust manifold of the engine and an air intake system of the engine, either one or both of entrance 62 and exit 164 may be made internal to the engine, thereby eliminating the need for separate conduits or tubing for conveyance of exhaust gas that is to be recirculated.

From entrance 162, passageway extends to through-hole 156 where inlet port 30 of valve 10 is located. It continues from the space within receptacle 148 that surrounds side wall 26 of cup 20, where valve outlet port 32 is located, to exit 164. When valve 10 is closed, exhaust gas cannot flow from entrance 162 to exit 164. When valve opens, flow is allowed to the extent that the valve is allowed to open by the associated control. At all times seal 158 prevents leakage past valve 10.

Valve 10 may be secured in place by any suitable means of attachment such as fastening by fasteners 166 acting on flange 22 of base 12 to hold the base secure on the head. Flange 22 may have an endless groove 168 containing a perimeter seal 170 for sealing between base 12 and receptacle 148. Rather than being a separate part, seal 170 may be fabricated by direct molding of material into groove 168.

A further feature that may be present for use in certain engines is a de-gas tube 172, metal for example, that is assembled to the outer margin of flange 22 beyond seal 170. Tube 172 is supported upright on flange 22 for registration with a de-gas hole 174 in wall 150 of head 142 when valve 10 is mounted on the head. A seal 176 seals the joint between the tube and the de-gas hole. The de-gas tube serves to provide a gas vent through which air can bleed from coolant passage 146 when the cooling system is being filed with liquid coolant. The de-gas tube is of course closed after that.

The two seals 170, 176 are like gaskets between the valve and cylinder head. But the area which they occupy is smaller than that of the face of flange 22 confronting the cylinder head. In this way significant metal-to-metal contact between the flange and cylinder head can be achieved when the flange is fastened tight against the cylinder head, and it is that metal-to-metal contact that promotes thermal conductivity between the two. Where an EGR valve is mounted on an engine not in association with a coolant passage, a thermal insulator is typically required between the valve and engine.

As hot exhaust gas is recirculated, coolant that circulates through coolant passage 146 aids in limiting peak temperatures to which valve 10 may be subjected. The metal of the cylinder head possesses good thermal conductivity. Surfaces 144 provide significant surface area for effective heat transfer to the coolant.

While a presently preferred embodiment of the invention has been illustrated and described, it should be appreciated that principles are applicable to other embodiments that fall within the scope of the following claims.

What is claimed is:

1. An internal combustion engine comprising a cylinder head comprising an exterior wall that contains a walled compartment comprising a wall exposed to an internal coolant passage in the head, through which passage liquid coolant circulates, an exhaust gas passageway through the walled compartment comprising an exhaust gas entrance into the compartment and an exhaust gas exit from the compartment,. the compartment comprising a receptacle that intersects the exhaust gas passageway between the entrance and the exit, and an EGR valve disposed on the exterior wall and comprising a base that has an inlet port and an outlet port and that is disposed within the receptacle with the inlet port open to the entrance via the passageway and the outlet port open to the exit via the passageway.

2. An internal combustion engine as set forth in claim 1 in which the base comprises stamped metal containing the inlet port and the outlet port.

3. An internal combustion engine as set forth in claim 2 in which the base comprises a cylindrical side wall containing the outlet port as at least one through-hole and an end wall at an end of the cylindrical side wall containing the inlet port as a through-hole.

4. An internal combustion engine as set forth in claim 3 in which the end wall of the base further comprises a formation in the stamped metal that forms a valve seat at the inlet port through which exhaust gas flow through the passageway is constrained to pass.

5. An internal combustion engine as set forth in claim 3 further including a seal sealing between the base and a all of the receptacle in circumscribing relation to the inlet port.

6. An internal combustion engine as set forth in claim 1 in which the valve further comprises a metal shell disposed on a central region of the base and containing an electric actuator that selectively positions a valve member relative to a valve seat on the base.

7. An internal combustion engine as set forth in claim 6 in which the base comprises stamped metal that includes a formation that forms the valve seat.

8. An internal combustion engine as set forth in claim 1 in which the exhaust gas entrance into the compartment is open to engine exhaust gas internally of the engine and the exhaust gas exit from the compartment is open to intake air internally of the engine.

9. An internal combustion engine as set forth in claim 1 in which the base comprises a flange disposed against an exterior surface of the exterior wall of the cylinder head valve stem, and a de-gas tube carried by the flange having registry with a through-hole in the exterior wall into the coolant passageway.

10. An internal combustion engine comprising a part having an exterior wall, a portion of which is covered on the exterior by an EGR valve that comprises a stamped metal base containing an inlet port and an outlet port, the portion of the exterior wall covered by the EGR valve comprising a walled compartment having a wall exposed to an internal coolant passage which passes internally through the part and through which liquid coolant circulates, an exhaust gas passageway through the walled compartment comprising an exhaust gas entrance into the compartment and an exhaust gas exit from the compartment, the compartment comprising a receptacle that intersects the exhaust gas passageway between the entrance and the exit, and the EGR valve inlet, port and outlet port are disposed within the receptacle with the inlet port open to the entrance via the passageway and the outlet port open to the exit via the passageway.

11. An internal combustion engine as set forth in claim 10 in which the part is an engine cylinder head.

12. An internal combustion engine as set forth in claim 10 in which the receptacle comprises a depression in the exterior wall of the part.

13. An internal combustion engine as set forth in claim 12 in which the depression in the exterior wall comprises a cylindrical side wall and an end wall at an end of the side wall, and the stamped metal base comprises a cylindrical side wall facing the cylindrical side wall of the depression and an end wall facing the end wall of the depression.

14. An internal combustion engine as set forth in claim 13 in which the inlet port is disposed in end wall of the base, and the end wall of the depression comprises a through-hole in registry with the inlet port.

15. An internal combustion engine comprising:

a part that contains a walled compartment having a wall exposed to liquid coolant circulating through an internal coolant passage running through the engine;

the walled compartment comprising a receptacle that has an opening to an exterior surface of the part, and an exhaust gas passageway having an entrance run along the wall for conveying engine exhaust gas to an entrance into the receptacle, and allowing heat transfer between the exhaust gas and the liquid coolant, and an exit run along the wall for conveying engine exhaust gas from an exit from the receptacle, and allowing heat transfer between the exhaust gas and the liquid coolant; and an EGR valve that is disposed in closure of the opening of the receptacle and that comprises an inlet port open to the entrance into the receptacle and an outlet port open to the exit from the receptacle.

16. An internal combustion engine as set forth in claim 15 wherein the EGR valve comprises a metal base containing the inlet port and the outlet port.

17. An internal combustion engine as set forth in claim 16 in which the base comprises a stamped metal part having a cylindrical side wall containing the outlet port as at least one through-hole and an end wall at an end of the cylindrical side wall containing the inlet port as a through-hole.

18. An internal combustion engine as set forth in claim 17 in which the end wall of the base further comprises a formation in the stamped metal that forms a valve seat at the inlet port through which exhaust gas flow through the passageway is constrained to pass.

19. An internal combustion engine as set forth in claim 16 in which the valve further comprises a metal shell disposed on a central region of the base and containing an electric actuator that selectively positions a valve member relative to a valve seat.

20. An internal combustion engine as set forth in claim 15 in which the part that contains the walled compartment wall comprises a cylinder head of the engine.

* * * * *